US005544862A

United States Patent [19]

Hickerson

[11] Patent Number: 5,544,862

[45] **Date of Patent: *Aug. 13, 1996**

[54] RESCUE TOOL

[75] Inventor: William Hickerson, Hardyston Township, N.J.

[73] Assignee: Curtiss Wright Flight Systems Inc., Fairfield, N.J.

[ * ] Notice: The term of this patent shall not extend beyond the expiration date of Pat. No. 5,297,780.

[21] Appl. No.: 289,842

[22] Filed: Aug. 12, 1994

Related U.S. Application Data

[63] Continuation of Ser. No. 94,502, Jul. 20, 1993, abandoned, which is a continuation-in-part of Ser. No. 952,688, Sep. 29, 1992, Pat. No. 5,297,780.

[51] Int. Cl.[6] ..... B66F 3/00

[52] U.S. Cl. ..... 254/124; 72/705

[58] Field of Search ..... 72/705, 449; 254/122, 254/124, 93 R, 133 R, 126, DIG. 2; 74/421 A

[56] References Cited

U.S. PATENT DOCUMENTS

| | | | |
|---|---|---|---|
| 2,580,829 | 1/1952 | Peck | 254/122 |
| 4,333,330 | 6/1982 | Porter | 72/705 |
| 4,569,644 | 2/1986 | Swedberg | 74/421 A |
| 4,573,364 | 3/1986 | Givan | 74/421 A |
| 4,721,016 | 1/1988 | Burandt . | |
| 4,742,730 | 5/1988 | Dorn et al. . | |
| 4,825,723 | 5/1989 | Martin . | |
| 4,842,249 | 6/1989 | Weigand . | |
| 4,880,274 | 11/1989 | Ichhikawa | 74/421 A |
| 4,896,862 | 1/1990 | Ganley . | |
| 4,951,261 | 8/1990 | Strehlow | 74/421 A |
| 5,007,811 | 4/1991 | Hopkins | 74/421 A |
| 5,085,407 | 2/1992 | Lonon | 254/DIG. 2 |
| 5,106,354 | 4/1992 | Russ et al. . | |
| 5,120,285 | 6/1992 | Grimm . | |

*Primary Examiner*—Robert C. Watson
*Attorney, Agent, or Firm*—Klauber & Jackson

[57] ABSTRACT

A light weight, quiet and emergency safe, portable "jaws of life" spreading tool actuated by an electric motor. Full high torque at any position, with selectable spreading or cutting motions under high loads is achieved by the use of a rotary, multiple stage, speed reducing gearbox driven by the motor. The gearbox contains an input stage from the electric motor running on a 12 volt DC power supply, and a compound planetary output stage. The arms or jaws of the device are separately driven by the planetary or spindle gears and, for convenience, are attached to external rings on the gears, by heavy duty pins. The arms or jaws are removable for interchanging between cutting and spreading configurations, or replacement with general purpose arms capable of both cutting and spreading operations.

9 Claims, 9 Drawing Sheets

RESCUE TOOL

This application is a continuation of application Ser. No. 08/094,502, filed Jul. 20, 1993, now abandoned, which is a CIP of 07/952,668, filed Sep. 29, 1992, now U.S. Pat. No. 5,297,780.

FIELD OF THE INVENTION

This invention relates to portable devices which deliver spreading or cutting motion under high loads and particularly those devices used for emergency rescue conditions and commonly referred to as "Jaws of Life" (registered trademark) type devices.

BACKGROUND OF THE INVENTION

Rescue tools known as "Jaws of Life" type devices are specialized tools used by various rescue personnel such as police, firemen, paramedics generally for the purpose of extricating accident victims from vehicles whose exits have been rendered inoperable. These tools require spreading and closing forces for opening or ripping apart inoperable doors or for cutting through relatively thick metal layers. Pushing and pulling forces of 7,000 to 15,000 pounds at the tips are considered to be normal for the proper operation of such tools. In the past, in order to achieve such high forces, the tools have been almost exclusively hydraulic and powered by gasoline engines, for example as described in U.S. Pat. No. 4,842,249.

With self contained hydraulic and gasoline units the tools were sufficiently portable for use under adverse conditions commonly encountered with the rescue of accident victims. Nevertheless, many "portable" units weigh in excess of 200 pounds and/or require at least two persons for operation or transport, since many "portable" units have separated powering and operation units.

Some tools, such as described in U.S. Pat. No. 4,896,862 are designed as separate jaw elements for use with various available powered inputs such as a pneumatic or hydraulic pumps or electric motors which drive threaded actuating elements. Though described as being powered with an electric motor, most devices are powered by gasoline or other fuel operated devices which provide the requisite driving power in a portable fashion. Electric power sources are not readily available in most emergency situations and portable batteries have not been considered capable of providing the requisite torque for effective operation of such devices.

As a result of the widespread use of hydraulic systems with fuel operated powering, as a general proposition, many of the existing tools also require constant costly maintenance of various components in order to maintain effectiveness.

Major drawbacks for most hydraulic system tools include their inability to generate full tip spreading force upon initial spreading application, the position at which such forces are needed most. Gasoline powered hydraulic devices are also very noisy and because of fuel containment exigencies, require special transport compartments. Other severe drawbacks include their detrimental susceptibility to environmental conditions including explosive atmospheres and inclement weather. A gasoline powered unit is dangerous to operate under many accident conditions wherein the speed required in the rescue is that of saving a victim from imminent harm in spreading flames.

SHORT DESCRIPTION OF THE INVENTION

It is an object of the present invention to provide a low maintenance, relatively inexpensive, safely operable, quiet, light weight, portable, battery powered "jaws of life" spreading and cutting rescue device having full spreading power in all positions.

It is a further object of the present invention to provide such portable battery powered rescue device having a rotary, multiple stage, speed reducing (torque increasing) gearbox.

It is a still further object of the present invention to provide such rescue device with a compound planetary output stage which provides operational forces comparable to existing hydraulically operated rescue devices.

It is yet another object of the present invention to provide such rescue device with replaceable arms which can be of cutting, spreading, or general use configuration as desired.

These and other objects, features and advantages will become more evident from the following discussion and the drawings in which:

SHORT DESCRIPTION OF THE DRAWINGS

DETAILED DESCRIPTION OF THE INVENTION

Figure 1:
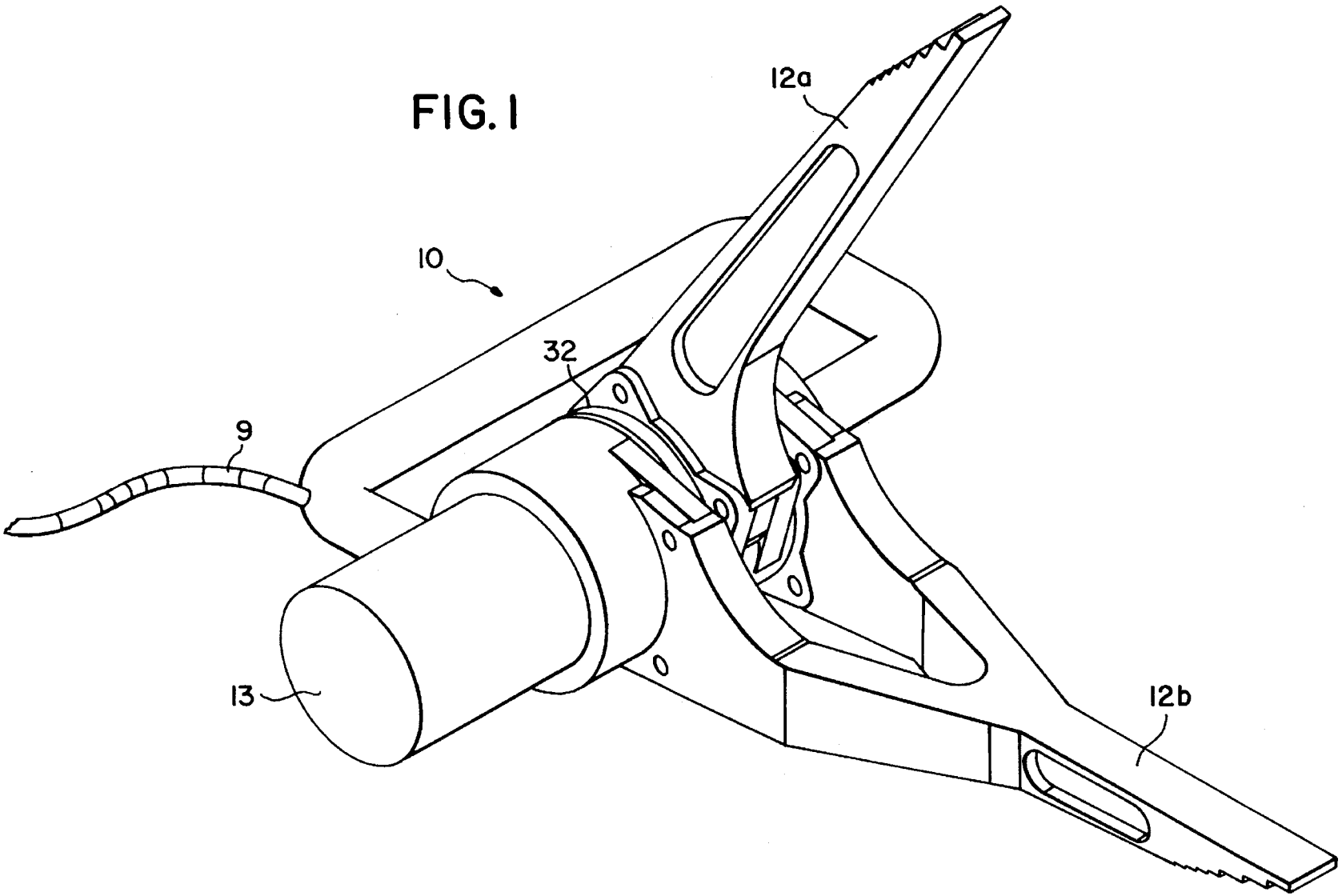
FIG. 1 is an isometric view of one embodiment of the device of the present invention with an in-line gear driving motor.

Generally the present invention comprises a truly light weight portable rescue device of the "Jaws of Life" type having arms which will quietly deliver cutting and/or spreading motions under very high loads and in any arm position. The device comprises a portable heavy duty motor, such as a motor utilized in operating portable winches, which is most preferably powered by a DC power supply such as typical 12 volt DC vehicle batteries. The output of the motor is converted to a low controllable speed and high torque by a rotary multiple stage gear box having a compound planetary output stage. The geared output permits the effective utilization of portable battery powering for use in a "Jaws of Life" type device.

In addition, the geared output permits high torque in all directions, thereby effectively providing a high torque drive for both spreading (outwardly moving arms) and cutting (inwardly moving arms). As a result, the device of the present invention is effectively operable with interchangeable cutting and spreading arms, or even combination cutting and spreading arms in a single drive unit. This is in marked contrast to many "Jaws of Life" type devices, such as with piston driven spreaders, e.g. as described in U.S. Pat. No. 4,333,330; or other spreader devices which use screw gears or hydraulics, which provide a maximum torque in only one direction. The gear box comprises a sun gear which is driven by the motor and planetary spindle gears driven by the sun gear. The output stage of the planetary spindle gears is connected to one or more of the spreading (or cutting) arms which emanate from a common vertex via ring gears and ring lugs. Because of the rotary output, the drive direction is easily reversed for selective cutting or spreading operations.

For safe operation it is preferred that the self contained electric motor be of an explosion proof type and that a fail-safe, electrically off, brake be interposed between the motor input and the geared output. Since the device is electrically powered by a vehicle battery there is no ignitable fuel and the tool is relatively safe for most rescue operations. The only maintenance required is periodic gear lubrication and even this can be dispensed with in a closed, self lubricating system.

Actuators, including gear boxes which have arms that extend from rotating ring gears of planetary gear systems and which are useful in the present invention, include those utilized in positioning aircraft flight control surfaces. Such actuators are disclosed in U.S. Pat. Nos. 4,721,016; 4,742,730; 4,825,723; and 5,120,285 as well as U.S. Pat. No. 5,106,354 which discloses a gear system designed for specific use in folding aircraft wings.

For ease and precision in operation, the device is provided with a large handle for stable two hand control and the handle is provided with a power switch for actuating of the arms in either the arms spreading (ripping) or arm closing (cutting or snipping) modes. The planetary gears drive ring gears with external ring lugs which are attached to the appropriate arms (high strength spreaders, sharpened cutters, combination spreaders and cutters, and the like) via removable pins. This provides the rapid ability to tailor the rescue tool to the particular situation. Either both arms are moved away from an original position or more preferably for simplified construction, one arm is fixed in position on the housing of the device and the other arm moves relative thereto.

A particularly desirable configuration for the geared torque increasing means is a compound planetary containing gearbox comprised of floating planet gears which eliminate the conventional carrier and planet support bearings.

Since the power supply (a 12 volt DC battery) is available in nearly any vehicle, and separable from the device, the present invention is truly lightweight (typically, with a weight of about thirty pounds as compared to common devices weighing in excess of 200 pounds and which require two people for operation) and substantially more portable than those of the prior art, with effective utilization by one person. Since the device carries no fuel it is also easily transported without the specialized carriers necessary with gasoline powered hydraulic equipment. In addition, the device is nearly as safe as simple mechanically operated tools under inclement conditions.

DETAILED DESCRIPTION OF THE PREFERRED EMBODIMENTS

With specific reference to the drawings, the embodiment shown in FIG. 1 depicts a rescue device 10 of the present invention, which, with spreading arms 12*a* and 12*b* having flat opposing surfaces, is specifically designed for ripping open or spreading operations. The spreading arms 12*a* and 12*b*, because of the high stress forces placed on them, are comprised of high strength tool steel and are apertured to reduce weight. The spreading tips of arms 12*a* and 12*b* are solid and stepped for appropriate selective placement in correspondingly sized openings.

Figure 5:
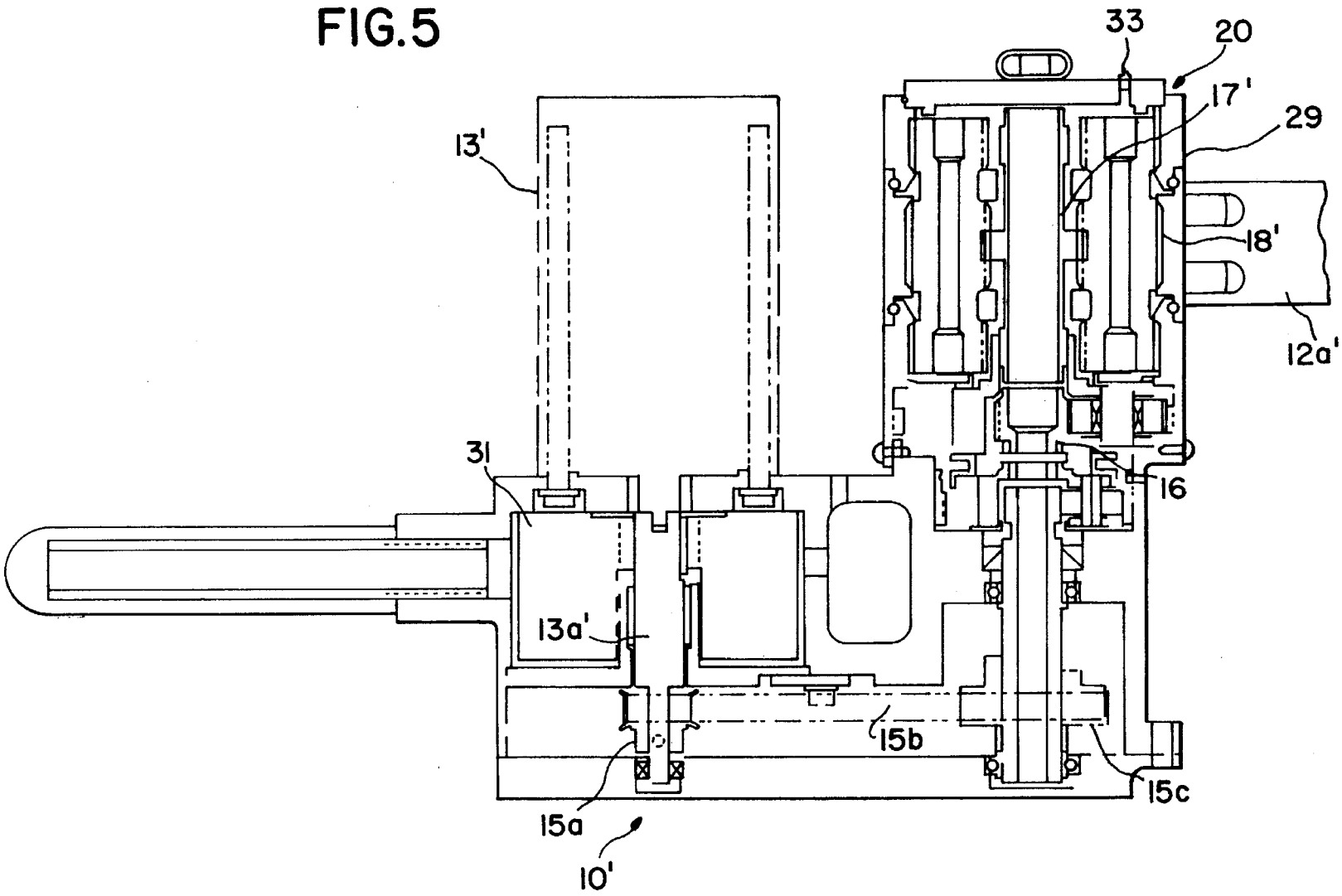
FIG. 5 is a top cutaway view of the device shown in FIGS. 3 and 4 showing the drive and torque increasing gear system.
Figure 6:
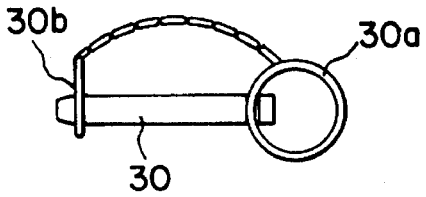
FIG. 6 is a side view of the arm attachment pin.
Figure 8:
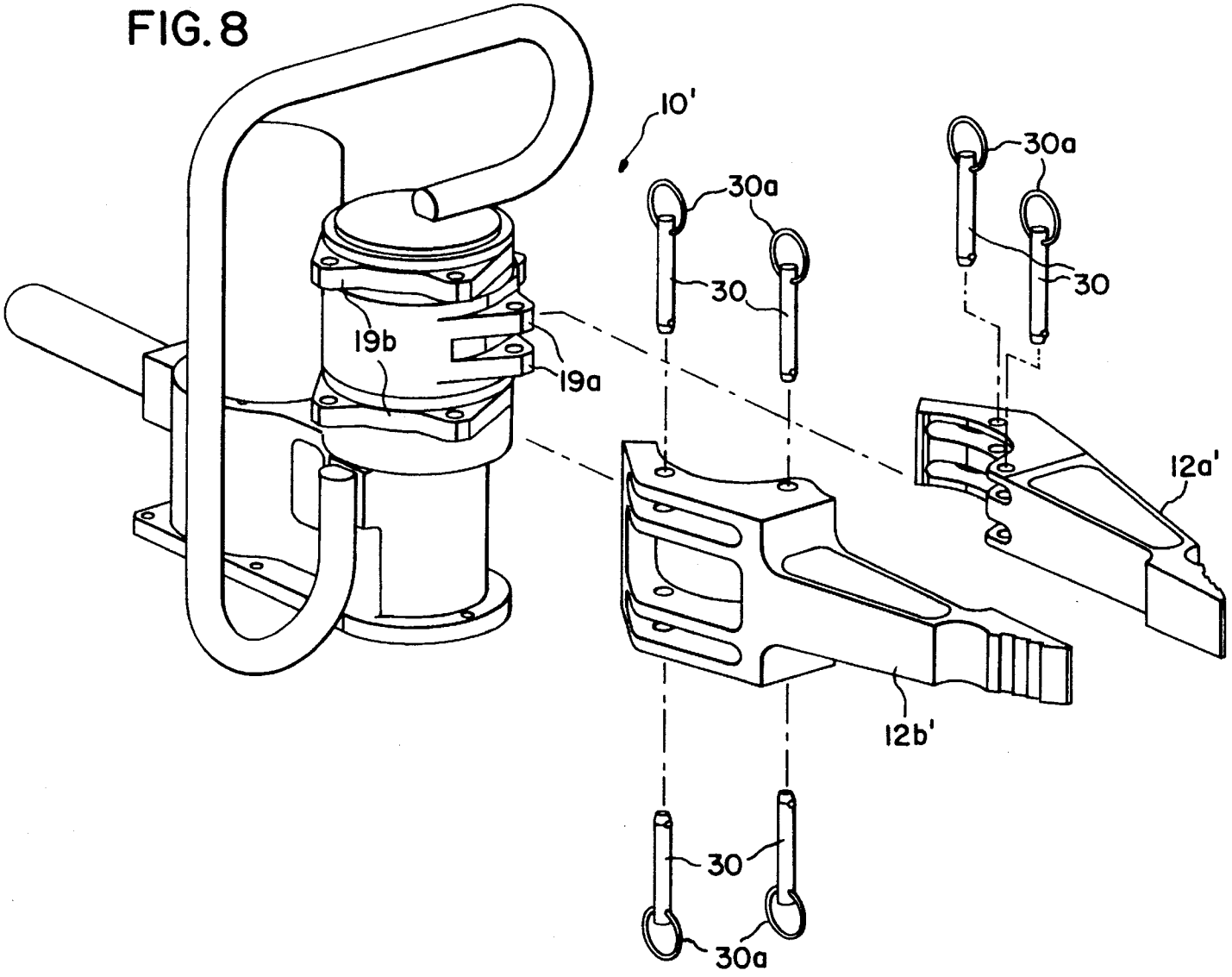
FIG. 8 is an exploded view of the embodiment of FIGS. 3–5 showing the removable arms and pin attachments.
Figure 9:
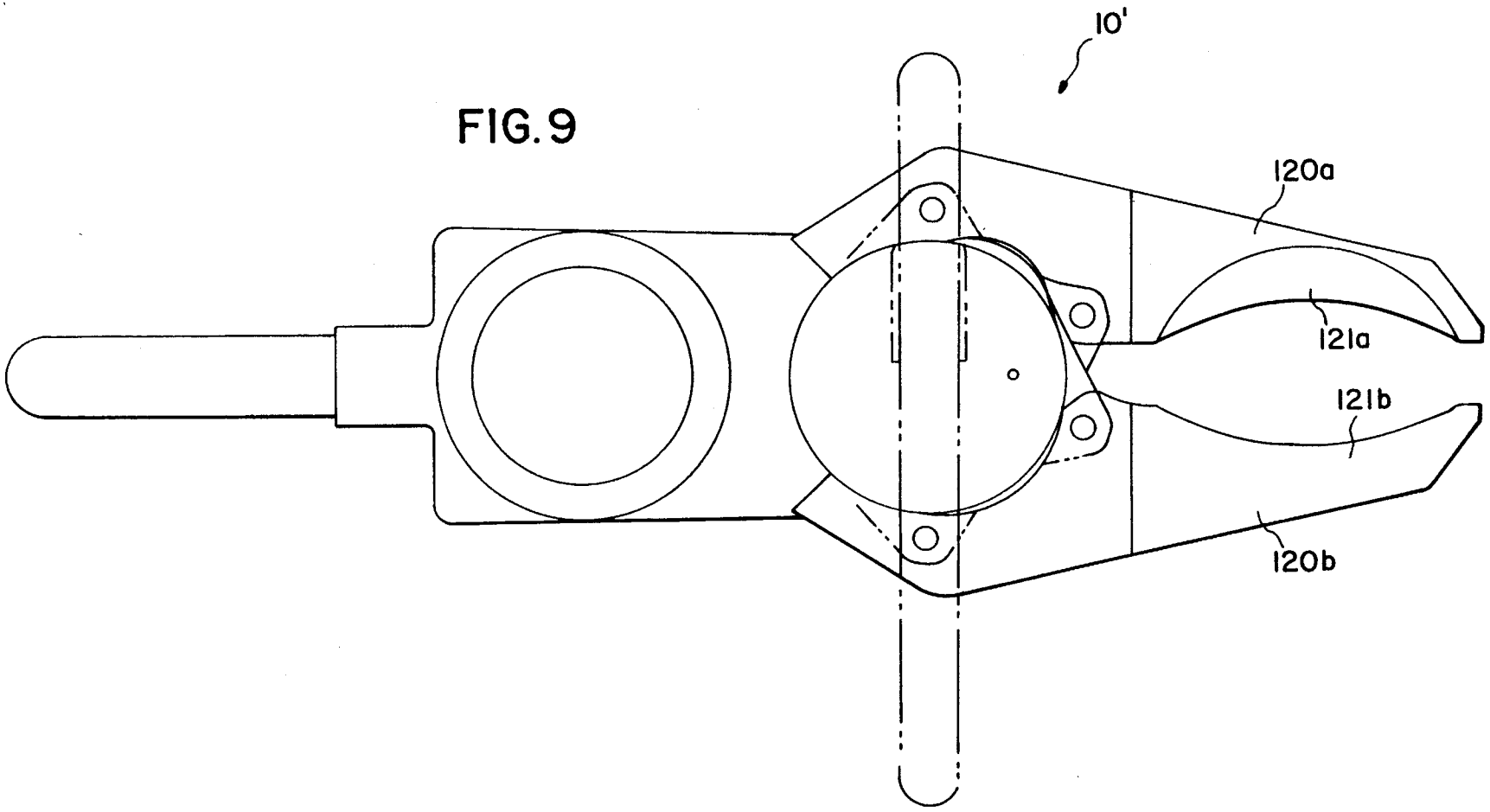
FIG. 9 is a side view of the device of the present invention having arms configured with cutting blades.
Figure 10:
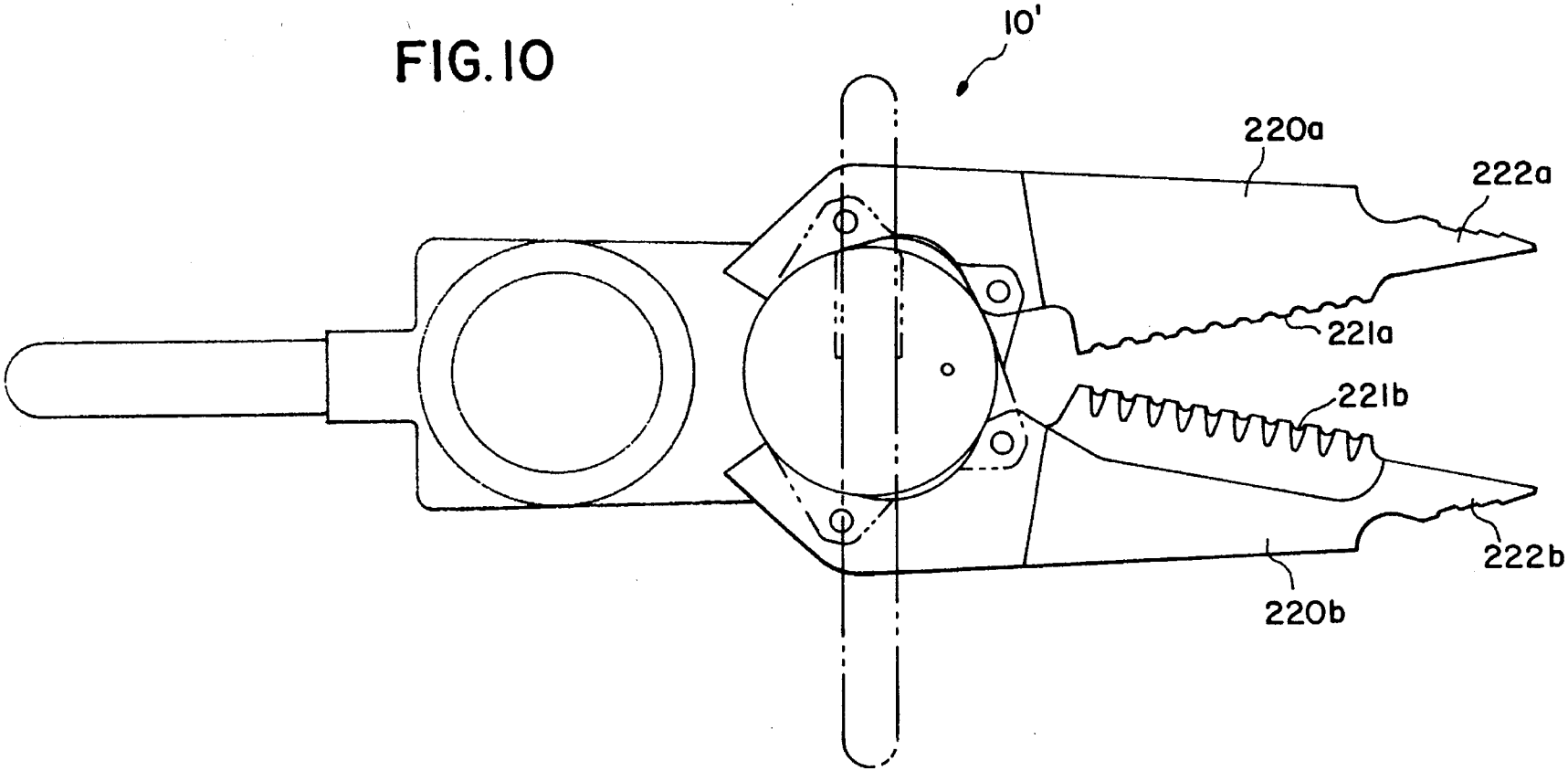
FIG. 10 is a side view of the device of the present invention having combination serrated cutting blade and expanding elements.

Heavy duty explosion proof motor 13, is powered by a 12 volt DC battery such as a vehicle battery (not shown) via power cable 9. The motor 13 directly drives the gearbox shown in FIG. 2. Input gears 14 translate rotary movement from motor 13, to turn sun gear 17. Centrally positioned sun gear 17 in turn causes rotation of planetary spindle gears 18 to drive ring gears 19, thereby providing the requisite high torque movement of arm 12*a* relative to fixed arm 12*b*. Arm 12*a* is removably attached to the pair of ring gear lugs 19*a* and arm 12*b* is removably attached to the pair of lugs 19*b* affixed to housing 32. Both arms 12*a* and 12*b* are attached by removable pins 30 (more clearly seen in FIG. 6) to the driving ring gear lugs 19*a* and housing lugs 19*b* respectively, whereby they can be removed and replaced with other arms such as cutting arms, suitable for particular rescue situations. FIG. 8 depicts an exploded view of the device of FIG. 5, showing the relative removable placement of the pins 30, gear lugs 19*a* and 19*b* and the arms 12*a* and 12*b*. Arms 120*a* and 120*b*, shown in FIG. 9, exemplify cutting arms with curved blade surfaces 121*a* and 121*b* respectively. Arms 220*a* and 220*b*, shown in FIG. 10, provide maximum general utility with serrated cutting blades 221*a* and 221*b* and spreading or ripping tips 222*a* and 222*b*.

The pins 30 comprise heavy duty machined steel rods with carrying ring 30*a* and reusable cotter type closing clip 30*b*.

Figure 7:
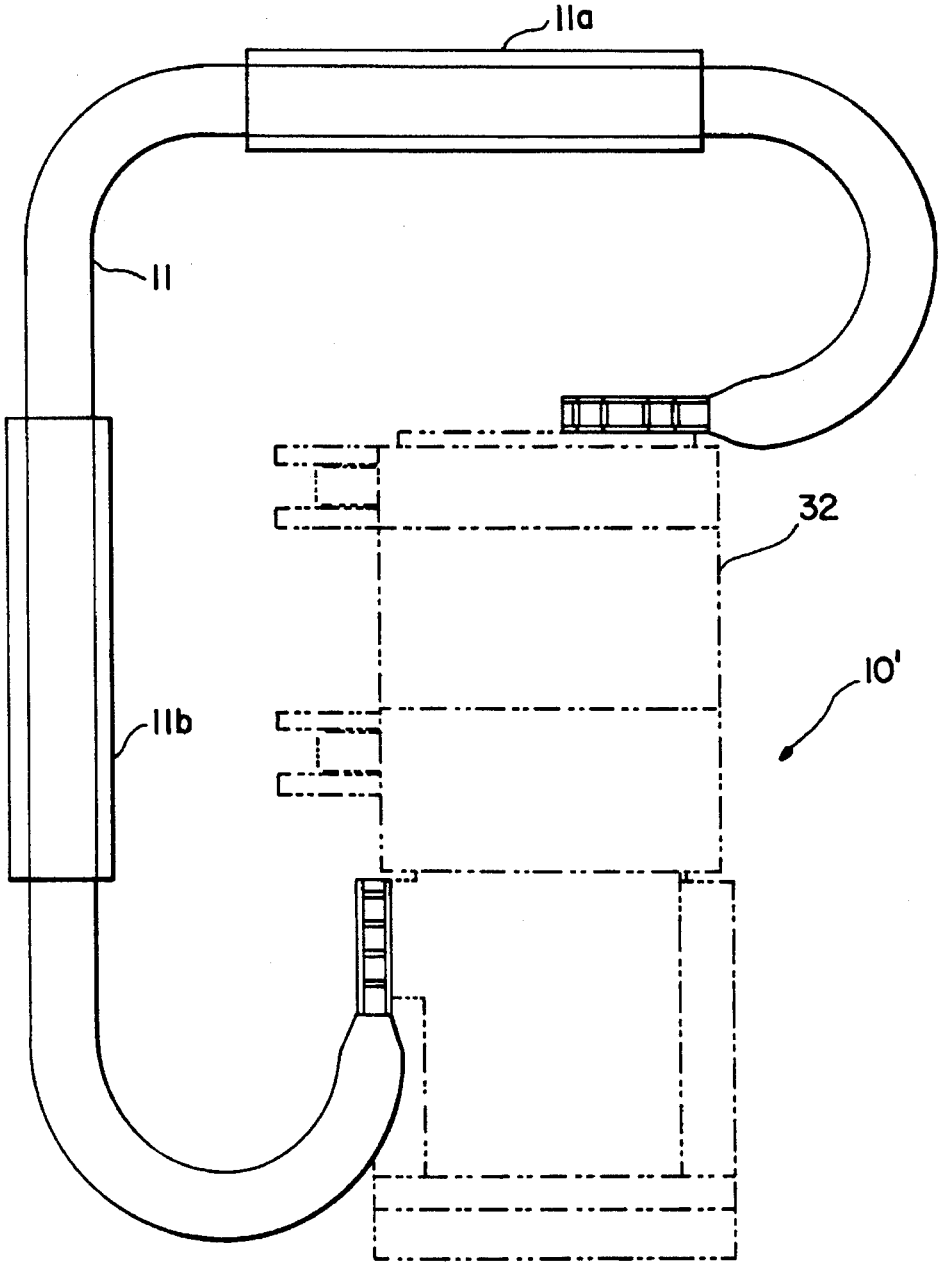
FIG. 7 is a top view showing the handle attachment in the various embodiments.

The device is gripped with two hands placed on full length handle 11 (more clearly seen in FIG. 7). Handle 11 is affixed to adjacent walls of housing 32 to provide for better control in handling. The handle 11 also contains a trigger switch (not shown) for discriminately turning the device on and off. A second switch (not shown) permits selective change of gear drive direction, whereby the direction of the arm movement is changed according to whether the arms are of a cutting or spreading configuration, or with general utility arms, according to the desired operation. Vinyl grips 11*a* and 11*b* facilitate the gripping.

Arm 12*b* is forked and is attached to housing lugs 19*b* and does not move during operation. Arm 12*a* is attached to lugs 19*b* of the ring gears 19, driven by the planetary output drive gears 18, whereby the spreading forces are concentrated on arm 12*a* and the relative movement between the arms 12*a* and 12*b*. Arm 12*a* fits within the fork of arm 12*b*, whereby they nest together in the adjacent closed position.

Figure 2:
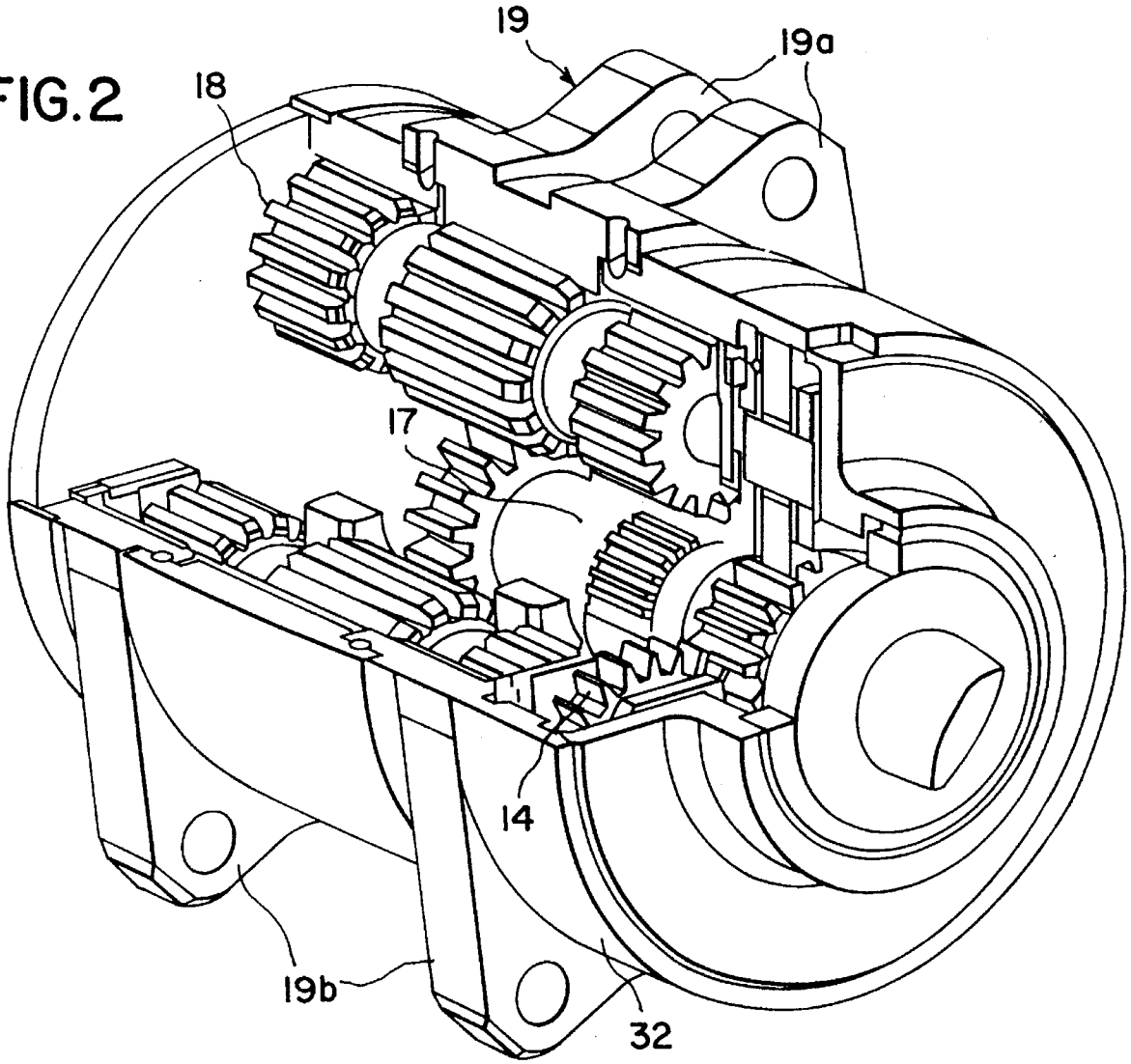
FIG. 2 is an isometric partial cutaway of the planetary gear arrangement in the embodiment of FIG. 1.
Figure 3:
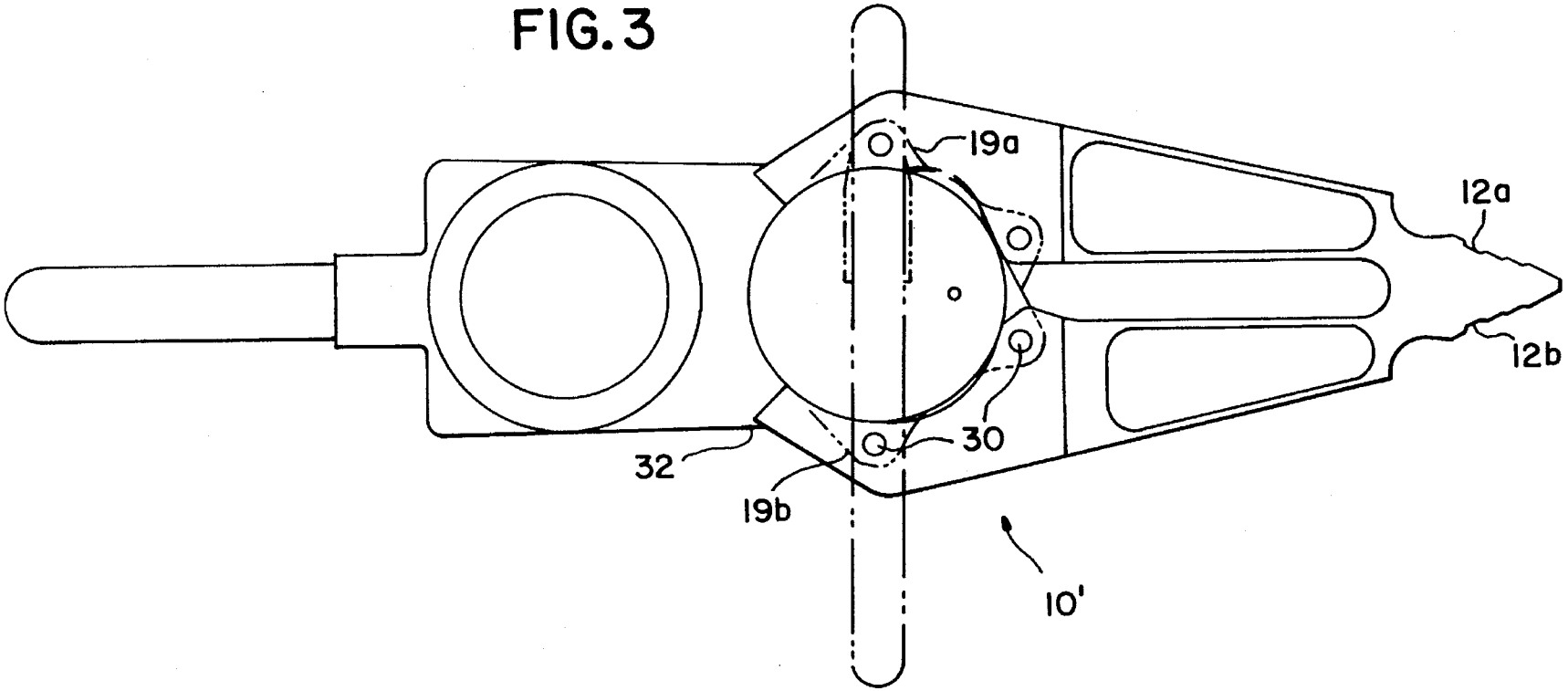
FIGS. 3 and 4 are right and left side views of a second embodiment of the device of the present invention with a motor parallel to the gearing and with a pulley drive.
Figure 4:
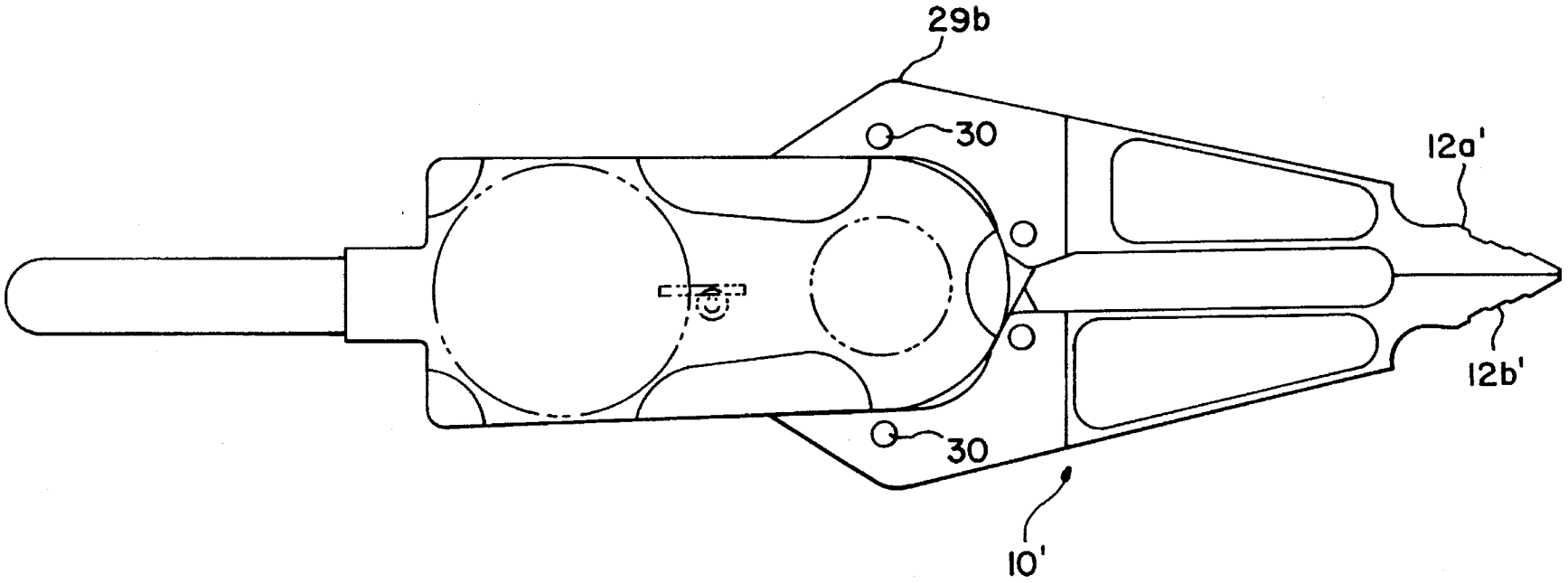

In the second embodiment shown in FIGS. 3–5, the device 10' is shown with a pulley drive 15, as opposed to the direct input gear drive shown for the embodiment of FIGS. 1 and 2. This permits a more compact design without the outward extension of the motor.

In this second embodiment, the arms 12*a'* and 12*b'* are shown in closed nested position, the initial spreading position. Arm 12*b'* is attached to the housing via lugs 29*b* and pin 30. Arm 12*a'* is attached to the driving ring gears 29 via ring gear lugs and pin 30.

In operation, as shown in FIG. 5, motor 13' drives shaft 13*a'* through safety fail safe brake 31 and pulley 15*a*. Pulley belt 15*b*, connecting pulleys 15*a* and 15*c*, in turn drives gear pulley 15*c*, which is attached to sun gear 16 for rotational power input to sun gear 17'. Sun gear 17', as with the embodiment shown in FIGS. 1 and 2, drives the multiple planetary gears of spindle gears 18'. As before, the planetary gears drive ring gears 29 for rotary movement of the attached arm 12*a'*. The gearing of the sun gear 17' and spindle gears 18' causes a reduction in rotational speed with an increase in torque which is transmitted to the moving arm 12*a'*.

The full torque forces, in excess of 7500 pounds, at the tips of the arms 12*a'* and 12*b'* are immediately available for ripping closed doors and the like from narrow confined areas without the necessity of separately providing starter openings.

For maintenance, grease fitting 33 is provided for periodic lubrication of gear box 20.

It is understood that the above description and drawings exemplify the present invention and that details contained therein are not to be construed as limitations on the present invention. Changes may be made such as in the geometry, dimensions, interrelation and types of elements without departing from the scope of the present invention as defined in the following claims.

What is claimed is:

1. A light weight portable rescue device having two arms which deliver rotational motion, therebetween, under very high loads, said rescue device comprising a portable heavy duty electric motor, and gear means for converting the output of the motor to a low controllable speed and high torque to at least one of said arms, said gear means comprising a rotary multiple stage gear box having a compound planetary output stage.

2. The light weight portable rescue device of claim 1, wherein said portable heavy duty motor is an electric motor capable of being powered by an electric battery.

3. A light weight portable rescue device having two arms for delivering a rotational motion, between said arms, under very high loads, said device comprising a portable heavy duty motor, and gear means for converting the output of the motor to a low controllable speed and high torque to at least one of said arms, said gear means comprising a rotary multiple stage gear box having a compound planetary output stage; wherein said device further comprises means for providing said high torque to at least one of said arms wherein said rotational motion is in a direction wherein said arms move toward each other and said device further comprises means for providing said high torque to at least one of said arms wherein said rotational motion is in a direction wherein said arms move away from each other.

4. The light weight portable rescue device of claim 3, wherein said arms comprise cutting means for cutting when said rotational motion is in a direction wherein said arms move toward each other and wherein said arms further comprise spreading means for spreading when said rotational motion is in a direction wherein said arms move away from each other.

5. A light weight portable rescue device having two arms for delivering a rotational motion between said arms under very high loads, comprising a portable heavy duty motor, and gear means for converting the output of the motor to a low controllable speed and high torque to at least one of said arms, said gear means comprising a rotary multiple stage gear box having a compound planetary output stage; with said arms being replaceably removable from said device, and wherein said device further comprises means for providing said high torque to at least one of said arms wherein said rotational motion is in a direction wherein said arms move toward each other and said arms comprise cutting means and said device further comprises means for providing said high torque to at least one of said arms wherein said rotational motion is in a direction wherein said arms move away from each other and wherein the arms comprising cutting means are replaced with arms comprising spreading means.

6. The light weight portable rescue device of claim 5, wherein said portable heavy duty motor is an electric motor capable of being powered by an electric battery.

7. A light weight portable rescue device having two arms which deliver rotational motion, therebetween, under very high loads, said rescue device comprising a portable heavy duty electric motor, and gear means for converting the output of the motor to a low controllable speed and high torque to at least one of said arms, in which one arm is attached to and movable with the outside of a ring gear which is driven from its internal side by said gear means.

8. The light weight portable rescue device of claim 7, wherein said portable heavy duty motor is an electric motor capable of being powered by an electric battery.

9. The light weight portable rescue device of claim 7, wherein said device further comprises means for providing said high torque to at least one of said arms wherein said rotational motion is in a direction wherein said arms move toward each other and said device further comprises means for providing said high torque to at least one of said arms wherein said rotational motion is in a direction wherein said arms move away from each other.

* * * * *